US008807560B2

(12) United States Patent
Hironaka et al.

(10) Patent No.: US 8,807,560 B2
(45) Date of Patent: Aug. 19, 2014

(54) RECORDING SHEET GUIDE STRUCTURE AND CARTRIDGE

(71) Applicants: Keita Hironaka, Oobu (JP); Hideaki Deguchi, Nagoya (JP)

(72) Inventors: Keita Hironaka, Oobu (JP); Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/951,527

(22) Filed: Jul. 26, 2013

(65) Prior Publication Data

US 2014/0027977 A1 Jan. 30, 2014

(30) Foreign Application Priority Data

Jul. 26, 2012 (JP) ..... 2012-165948

(51) Int. Cl.
*B65H 5/00* (2006.01)

(52) U.S. Cl.
USPC ..... 271/264; 399/397

(58) Field of Classification Search
USPC ..... 271/264; 399/397–399, 315; 400/642, 400/644
See application file for complete search history.

(56) References Cited

U.S. PATENT DOCUMENTS

| | | | | |
|---|---|---|---|---|
| 4,223,993 | A | 9/1980 | Tsuda et al. | |
| 4,338,017 | A | 7/1982 | Nishikawa | |
| 5,477,314 | A | 12/1995 | Tsuchiya et al. | |
| 5,893,558 | A * | 4/1999 | Konig et al. | 271/264 |
| 5,926,683 | A | 7/1999 | Yuminamochi et al. | |
| 6,219,505 | B1 | 4/2001 | Sato et al. | |
| 7,720,430 | B2 * | 5/2010 | Hasegawa et al. | 399/397 |
| 8,322,714 | B2 * | 12/2012 | Satomi | 271/264 |
| 2001/0026705 | A1 | 10/2001 | Sato et al. | |
| 2001/0031154 | A1 | 10/2001 | Sato et al. | |
| 2003/0049043 | A1 | 3/2003 | Fuwazaki et al. | |
| 2006/0099004 | A1 | 5/2006 | Hasegawa et al. | |
| 2008/0296837 | A1 * | 12/2008 | Jowett et al. | 271/264 |

FOREIGN PATENT DOCUMENTS

| | | | |
|---|---|---|---|
| JP | 06-027844 | A | 2/1994 |
| JP | 09-106239 | A | 4/1994 |
| JP | 07-319298 | A | 8/1995 |
| JP | 07-237777 | A | 9/1995 |

(Continued)

OTHER PUBLICATIONS

Notification of Reasons for Refusal issued in corresponding Japanese Patent Application No. 2005-024226 mailed Sep. 29, 2009.

(Continued)

*Primary Examiner* — Michael McCullough
(74) *Attorney, Agent, or Firm* — Banner & Witcoff, Ltd.

(57) ABSTRACT

A recording sheet guide structure configured to guide a recording sheet conveyed between an image carrier and a transfer part, including: a pair of first guide parts including first ridgeline parts which are configured to respectively slidingly contact with a transfer surface side of both end portions of a first recording sheet having a first width; and a pair of second guide parts including second ridgeline parts which are configured to respectively slidingly contact with a transfer surface side of both end portions of a second recording sheet having a second width narrower than the first width, wherein the pair of second guide parts is positioned at an inner side of the pair of first guide parts in a width direction and is arranged at a downstream side than the pair of first guide parts in a conveyance direction of the recording sheet.

13 Claims, 6 Drawing Sheets

(56) References Cited

FOREIGN PATENT DOCUMENTS

| | | | |
|---|---|---|---|
| JP | 09-134103 | A | 5/1997 |
| JP | 10-232570 | A | 9/1998 |
| JP | 2000-194241 | A | 7/2000 |
| JP | 2000-227743 | A | 8/2000 |
| JP | 2001-154495 | A | 6/2001 |
| JP | 2002-072696 | A | 3/2002 |
| JP | 2002-123096 | A | 4/2002 |
| JP | 2002-328552 | A | 11/2002 |
| JP | 2006-146117 | A | 6/2006 |

OTHER PUBLICATIONS

Notification of Reasons for Refusal issued in corresponding Japanese Patent Application No. 2005-024226 mailed Feb. 2, 2010.

* cited by examiner

RECORDING SHEET GUIDE STRUCTURE AND CARTRIDGE

CROSS-REFERENCE TO RELATED APPLICATIONS

This application claims priority from Japanese Patent Application No. 2012-165948 filed on Jul. 26, 2012, the entire contents of which are incorporated herein by reference.

TECHNICAL FIELD

Aspects of the invention relate to a recording sheet guide structure for guiding a recording sheet that is conveyed between an image carrier and a transfer part, and a cartridge including the recording sheet guide structure.

BACKGROUND

An image forming apparatus of an electrophotographic type has been known which includes an image carrier and a transfer part for transferring an image to a recording sheet, specifically, a photosensitive drum and a transfer roller, and an attraction suppressing part suppressing the recording sheet conveyed between the photosensitive drum and the transfer roller from being attracted towards a process cartridge.

As the attraction suppressing part, there has been known a first protrusion part that protrudes towards both end portions of the recording sheet in a width direction and a second protrusion part having a rib shape that is arranged at a position closer to a center of the recording sheet in the width direction than the first protrusion part and extending in a conveyance direction of the recording sheet.

The first protrusion part protrudes so that a protruding amount thereof is gradually reduced from both end sides of the recording sheet in the width direction towards the center thereof. The first protrusion part has an inclined surface that is inclined relative to an image formation surface (transfer surface) of the recording sheet. The inclined surface is configured so as to become gradually closer to the recording sheet as it is directed towards a downstream side of the recording sheet in a conveyance direction and both end sides of the recording sheet in the width direction.

A plurality of the second protrusion parts is provided at an interval in the width direction of the recording sheet to be conveyed. A distance between the second protrusion part and the recording sheet to be conveyed is configured to be smaller than a distance between the first protrusion part and the recording sheet to be conveyed.

According to the image forming apparatus, however, when a recording sheet narrower than a distance between the first protrusion parts is conveyed between the photosensitive drum (the image carrier) and the transfer roller (the transfer part), the second protrusion having a rib shape rubs against a transfer surface of the recording sheet, thereby contaminating the transfer surface.

SUMMARY

Accordingly, an object of the invention is to provide a recording sheet guide structure capable of conveying both a wide recording sheet and a narrow recording sheet between an image carrier and a transfer part while appropriately separating the recording sheet from the image carrier, irrespective of a width size of the recording sheet, thereby suppressing contamination of a transfer surface of the recording sheet.

Further, an object of the present invention is to provide a cartridge including the recording sheet guide structure.

According to an aspect of the present invention, there is provided a recording sheet guide structure configured to guide a recording sheet conveyed between an image carrier and a transfer part. The recording sheet guide structure includes a pair of first guide parts and a pair of second guide parts. The pair of first guide parts includes first ridgeline parts which are configured to respectively slidingly contact with a transfer surface side of both end portions of a first recording sheet having a first width in a width direction, and is configured to guide the both end portions of the first recording sheet in a direction of separating the first recording sheet from the image carrier. The pair of second guide parts includes second ridgeline parts which are configured to respectively slidingly contact with a transfer surface side of both end portions of a second recording sheet having a second width narrower than the first width of the first recording sheet in the width direction, and is configured to guide the both end portions of the second recording sheet in a direction of separating the second recording sheet from the image carrier. The pair of second guide parts is positioned at an inner side of the pair of first guide parts in the width direction and is arranged at a downstream side than the pair of first guide parts in a conveyance direction of the recording sheet.

According to another aspect of the present invention, there is provided a cartridge including an image carrier and a recording sheet guide structure. The recording sheet guide structure is configured to guide a recording sheet conveyed between the image carrier and a transfer part. The recording sheet guide structure includes a pair of first guide parts and a pair of second guide parts. The pair of first guide parts includes first ridgeline parts which are configured to respectively slidingly contact with a transfer surface side of both end portions of a first recording sheet having a first width in a width direction, and is configured to guide the both end portions of the first recording sheet in a direction of separating the first recording sheet from the image carrier. The pair of second guide parts includes second ridgeline parts which are configured to respectively slidingly contact with a transfer surface side of both end portions of a second recording sheet having a second width narrower than the first width of the first recording sheet in the width direction, and is configured to guide the both end portions of the second recording sheet in a direction of separating the second recording sheet from the image carrier. The pair of second guide parts is positioned at an inner side of the pair of first guide parts in the width direction and is arranged at a downstream side than the pair of first guide parts in a conveyance direction of the recording sheet.

According to another aspect of the present invention, there is provided a cartridge including: an image carrier extending a first direction; and a frame configured to accommodate the image carrier and including a first guide part and a second guide part, wherein the first guide part includes a first ridgeline part which is configured to respectively slidingly contact with a transfer surface side of an end portion of a first recording sheet in the first direction, and configured to guide the transfer surface end portion of the first recording sheet in a direction of separating the first recording sheet from the image carrier, wherein the second guide part includes a second ridgeline part which is configured to respectively slidingly contact with a transfer surface side of an end portion of a second recording sheet having a second width narrower than a first width of the first recording sheet in the first direction, and configured to guide the end portion of the second recording sheet in a direction of separating the second recording sheet from the image carrier, and wherein the second guide part is positioned at an inner side of the first guide part in the first direction and is arranged at a downstream side than the first guide part in a conveyance direction of the recording sheet.

According to the recording sheet guide structure or cartridge of the invention, it is possible to convey both a wide recording sheet and a narrow recording sheet between the image carrier and the transfer part while appropriately separating the recording sheet from the image carrier, irrespective of the width size of the recording sheet, thereby suppressing contamination of the transfer surface of the recording sheet.

BRIEF DESCRIPTION OF DRAWINGS

FIG. 5 is a view illustrating an operation of the recording sheet guide structure according to an illustrative embodiment, in which

DETAILED DESCRIPTION

Hereinafter, an illustrative embodiment of the recording sheet guide structure of the invention will be specifically described with reference to the drawings. The recording sheet guide structure of the illustrative embodiment configures a part of a process cartridge of a laser printer 1 shown in FIG. 1, for example. Thus, the laser printer 1 will be first schematically described and then the recording sheet guide structure will be specifically described. Meanwhile, in the following descriptions, a left direction of the sheet of FIG. 1 is referred to as a "rear" direction, a right direction is referred to as a "front" direction, the upper and lower directions are referred to as "upper" and "lower" directions, the front side direction is referred to as a "left" direction and the back side direction is referred to as the "right" direction.

<Schematic Configuration of Laser Printer>

Figure 1:
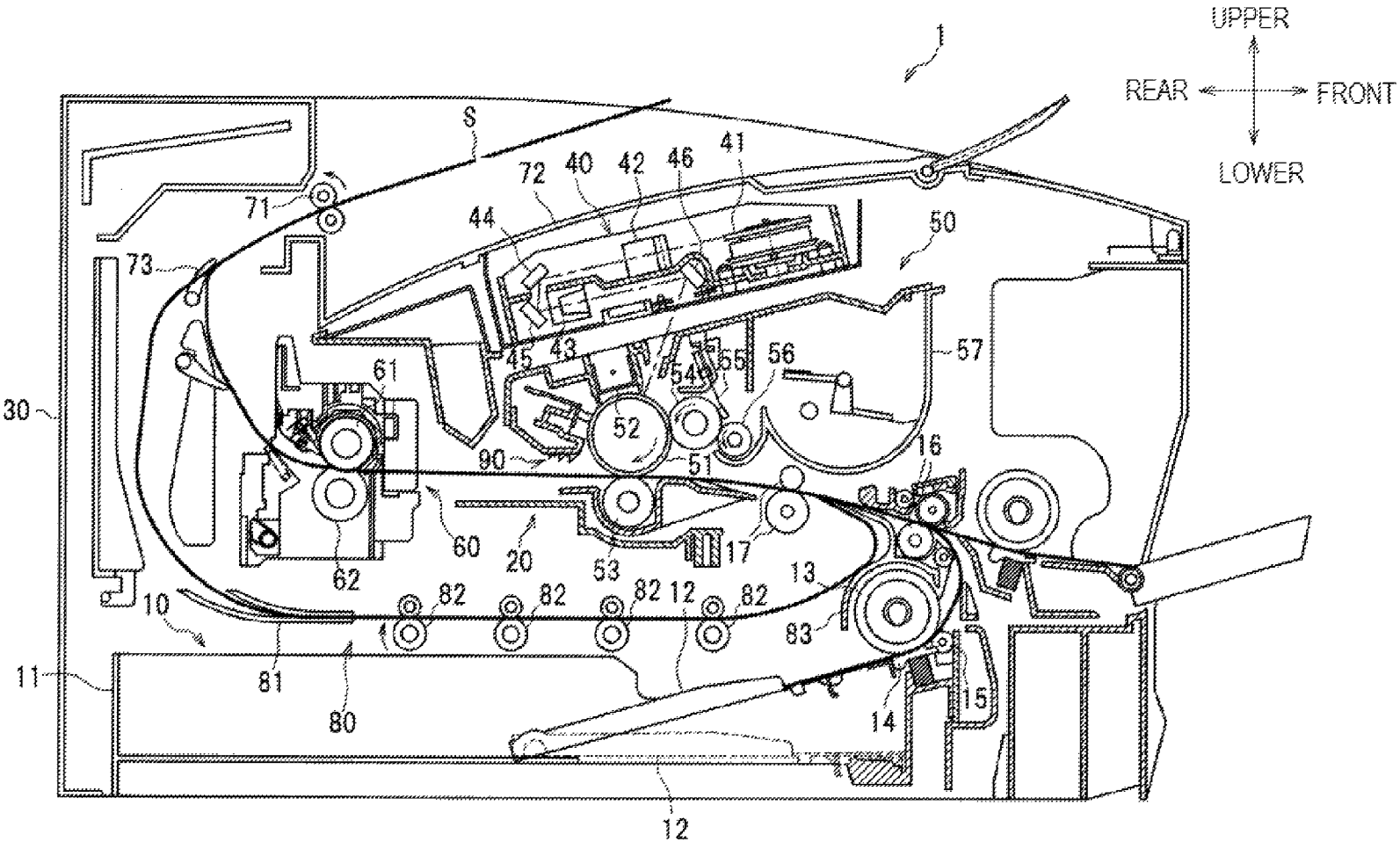
FIG. 1 is a side sectional view showing a schematic configuration of a laser printer having a recording sheet guide structure according to an illustrative embodiment of the invention.

As shown in FIG. 1, the laser printer 1 has a body casing 30 in which a feeder 10 for feeding a sheet S, which is an example of the recording sheet, an image forming part 20 for forming an image on the sheet S, and the like, are stored. Here, the image forming part 20 includes a scanner 40 that is an exposure part, a process cartridge 50 that configures the developing part and the transfer part, a fixing part 60, and the like.

<Configuration of Feeder>

The feeder 10 has a sheet feeding tray 11 that is detachably mounted to a bottom part in the body casing 30 and a sheet pressing plate 12 that is arranged at a front side part in the sheet feeding tray 11. Also, the feeder 10 has a feeder roller 13 and a sheet feeding pad 14, which are arranged above a front end portion of the sheet feeding tray 11, and paper powder removal rollers 15, 16 that are arranged at a downstream side in a conveyance direction of the sheet S with respect to the feeder roller 13. Also, the feeder 10 has register rollers 17 that are arranged at a downstream side in the conveyance direction of the sheet S with respect to the paper powder removal rollers 15, 16.

In the feeder 10, the sheet S that is accommodated in the sheet feeding tray 11 is inclined towards the feeder roller 13 by the sheet pressing plate 12. The sheet S sandwiched between the feeder roller 13 and the sheet feeding pad 14 is conveyed to the image forming part 20 via the paper powder removal rollers 15, 16 and the register rollers 17 by rotation of the feeder roller 13.

<Configuration of Scanner>

The scanner 40 is arranged at the upper portion in the body casing 30 and has a laser light emitting part (not shown), a polygon mirror 41, lenses 42, 43 and reflecting mirrors 44, 45, 46. In the scanner 40, a laser beam passes to a path shown with a dashed-dotted line and is then illuminated on a surface (peripheral surface) of a photosensitive drum 51 in the process cartridge 50 by high-speed scanning <Configuration of Process Cartridge>

The process cartridge 50 is detachably mounted to the body casing 30 to be mounted below the scanner 40. The process cartridge 50 has the photosensitive drum 51, a scorotron-type charger 52, a transfer roller 53, a developing roller 54, a layer thickness regulation blade 55, a supply roller 56 and a toner hopper 57.

In the process cartridge 50, a surface of the photosensitive drum 51 charged by the scorotron-type charger 52 is exposed by the laser beam emitted from the scanner 40, so that an electrostatic latent image is formed on the surface of the photosensitive drum 51. Toner in the toner hopper 57 as developer is supplied to the electrostatic latent image through the supply roller 56 and the developing roller 54, so that a toner image (developer image) is formed on the surface of the photosensitive drum 51. After that, when the sheet S is conveyed between the photosensitive drum 51 and the transfer roller 53, a transfer bias is applied to the transfer roller 53, so that the toner image carried on the surface of the photosensitive drum 51 is transferred to a surface of the sheet S by the transfer roller 53. By doing so, an image is formed on the surface of the sheet S.

<Configuration of Fixing Part>

The fixing part 60 has a heating roller 61 for heat-fixing the toner image transferred on the sheet S and a pressing roller 62 that presses the sheet sandwiched between the heating roller 61 and the pressing roller 62. The fixing part 60 is arranged at a downstream side in the conveyance direction of the sheet S conveyed from the process cartridge 50. The sheet S heat-fixed in the fixing part 60 is discharged onto a sheet discharge tray 72, which is outside the body casing 30, by a pair of discharge rollers 71 that is rotated in the conveyance direction of the sheet S.

Here, when performing duplex printing of forming images on both sides of the sheet S, the discharge rollers 71 are rotated in a reverse direction before the entire sheet S is discharged onto the sheet discharge tray 72, so that the sheet S is returned into the body casing 30. The sheet S returned into the body casing 30 passes a rear side of the fixing part 60 and is then delivered to a both-side conveyance path unit 80, by switching a flapper 73.

<Configuration of Both-Side Conveyance Path Unit>

The both-side conveyance path unit 80 is a re-conveyance mechanism for both-side conveyance and is provided between the image forming part 20 and the sheet feeding tray 11. Here, the "both-side conveyance" is a conveyance operation for reversing the inside and outside of the sheet S and then returning the same to between the photosensitive drum 51 and the transfer roller 53 of the process cartridge 50 so as to perform a print job on a back surface of the sheet S having a printed front surface.

The both-side conveyance path unit 80 has a guide member 81 that switches a direction of the sheet S, which passes the rear side of the fixing part 60 and is being conveyed downwards, to the front side, and a plurality of pairs of returning rollers 82 that is arranged side by side in the front-rear direction so as to return the sheet S guided by the guide member 81 to the front side of the photosensitive drum 51. The sheet S discharged from the both-side conveyance path unit 80 is guided towards the register rollers 17 by a guide 83 provided at the front of the both-side conveyance path unit 80. The sheet S is guided towards the register rollers 17 with the front and back surfaces thereof being reversed. Thereby, a leading end of the sheet S is lined up at the register rollers 17 and the sheet S is again conveyed to between the photosensitive drum 51 and the transfer roller 53, so that the toner image on the photosensitive drum 51 is transferred to the other surface of the sheet S.

<Configuration of Recording Sheet Guide Structure>

Subsequently, a recording sheet guide structure 90 of an illustrative embodiment is described with reference to FIGS. 2 and 3. In the process cartridge 50 shown in FIG. 1, the recording sheet guide structure 90 is a structure for guiding the sheet S, which is conveyed between the photosensitive drum 51 configuring the image carrier and the transfer roller 53 configuring the transfer part, in a direction of separating the sheet S from the photosensitive drum 51.

Figure 2:
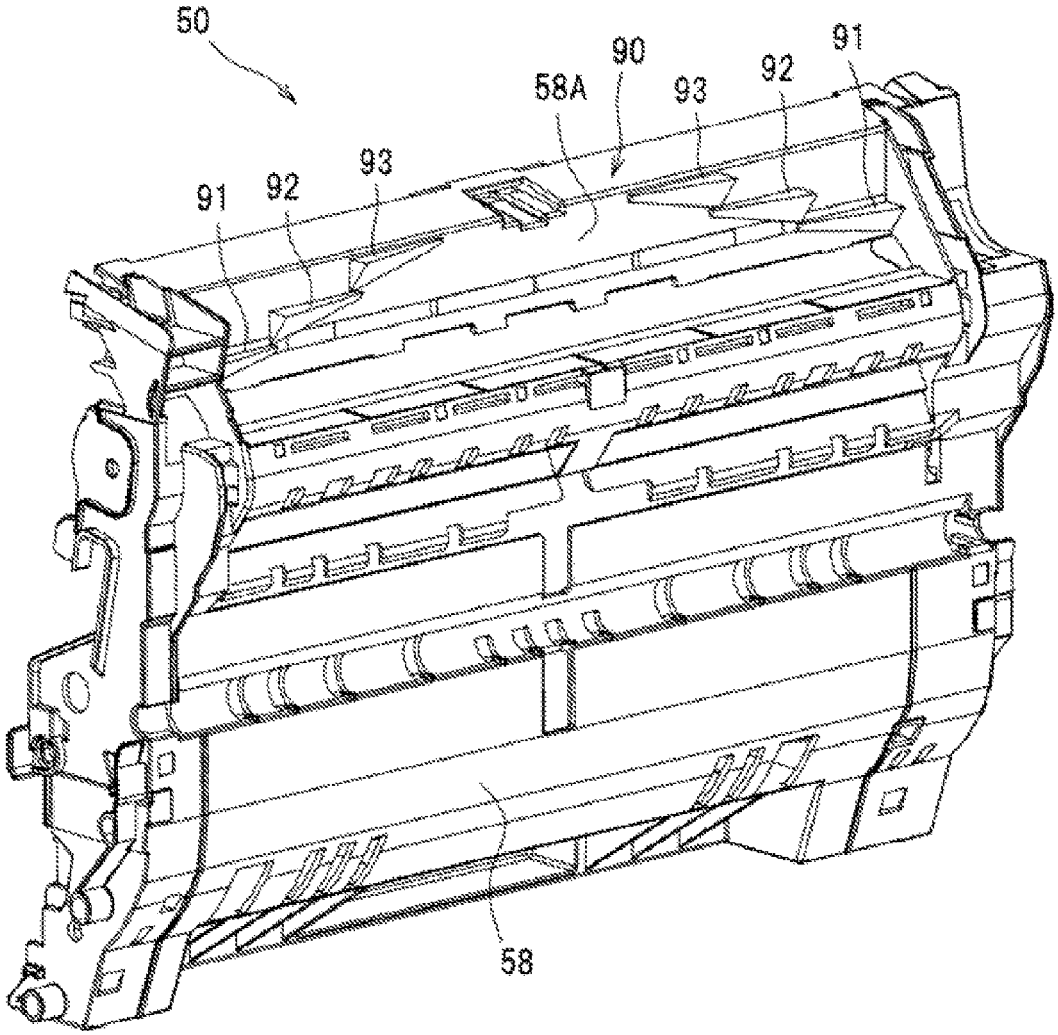
FIG. 2 is a perspective view of a process cartridge shown in FIG. 1, which is viewed from a bottom surface side.

As shown in FIG. 2, the recording sheet guide structure 90 has a pair of first guide parts 91, 91, a pair of second guide parts 92, 92 and a pair of third guide parts 93, 93. The guide parts are integrally formed to a rear-side bottom surface 58A of a frame 58 supporting the photosensitive drum 51 (see FIG. 1) of the process cartridge 50.

<Configuration of First Guide Parts>

Figure 3:
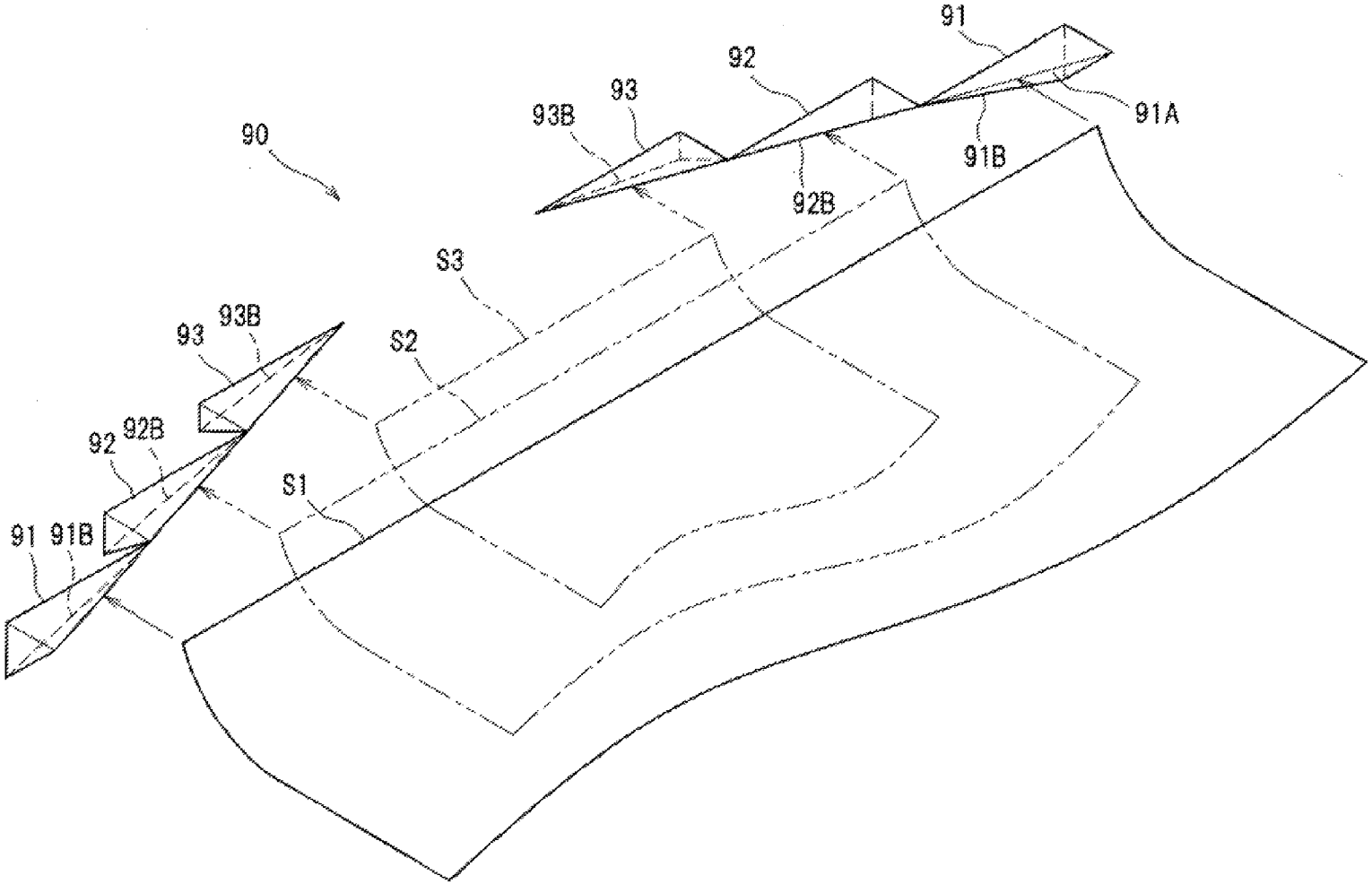
FIG. 3 is a pictorial perspective view illustrating an operation of the recording sheet guide structure according to an illustrative embodiment.

As shown in FIG. 3, the pair of first guide parts 91, 91 corresponds to a first recording sheet having a first width, for example, an A4-sized sheet 51 having a width of 210 mm, and is arranged to face both end portions of a front end portion of the sheet 51 to be conveyed, in the width direction. The first guide parts 91, 91 have first guide inclined surfaces 91A, 91A that abut on both end portions of the front end portion of the sheet 51, which is curved towards the photosensitive drum 51, in the width direction and thus guide the sheet 51 in a direction of separating the sheet 51 from the photosensitive drum 51 (see FIG. 4). Also, the first guide parts 91, 91 have a pair of first ridgeline parts 91B, 91B that slidingly contact with a transfer surface side of both end portions of the sheet 51 in the width direction, which is guided by the first guide inclined surfaces 91A, 91A (see FIG. 5).

<Configuration of Second Guide Parts>

The pair of second guide parts 92, 92 corresponds to a second recording sheet having a second width, for example, a B5-sized sheet S2 having a width of 182 mm, and is arranged to face both end portions of a front end portion of the sheet S2 to be conveyed, in the width direction. The second guide parts 92, 92 have second guide inclined surfaces 92A, 92A that abut on both end portions of the front end portion of the sheet S2, which is curved towards the photosensitive drum 51, in the width direction and thus guide the sheet S2 in the direction of separating the sheet S2 from the photosensitive drum 51 (see FIG. 4). Also, the second guide parts 92, 92 have a pair of second ridgeline parts 92B, 92B that slidingly contact with a transfer surface side of both end portions of the sheet S2 in the width direction, which is guided by the second guide inclined surfaces 92A, 92A (see FIG. 5).

<Configuration of Third Guide Parts>

The pair of third guide parts 93, 93 corresponds to a third recording sheet having a third width, for example, an A5-sized sheet S3 having a width of 148 mm, and is arranged to face both end portions of a front end portion of the sheet S3 to be conveyed, in the width direction. The third guide parts 93, 93 have third guide inclined surfaces 93A, 93A that abut on both end portions of the front end portion of the sheet S3, which is curved towards the photosensitive drum 51, in the width direction and thus guide the sheet S3 in the direction of separating the sheet S3 from the photosensitive drum 51 (see FIG. 4). Also, the third guide parts 93, 93 have a pair of third ridgeline parts 93B, 93B that slidingly contact with a transfer surface side of both end portions of the sheet S3 in the width direction, which is guided by the third guide inclined surfaces 93A, 93A (see FIG. 5).

<Arrangement of Respective Guide Parts>

As shown in FIG. 3, the pair of second guide parts 92, 92 is arranged at an inner side of the pair of first guide parts 91, 91 in the width direction and the pair of third guide parts 93, 93 is arranged at an inner side of the pair of third guide parts 93, 93 in the width direction (see FIG. 5). Also, the pair of second guide parts 92, 92 is arranged at a downstream side in the conveyance direction of the sheet S than the pair of first guide parts 91, 91, and the pair of third guide parts 93, 93 is arranged at the downstream side in the conveyance direction of the sheet S than the pair of second guide parts 92, 92 (see FIG. 4).

Figure 4:
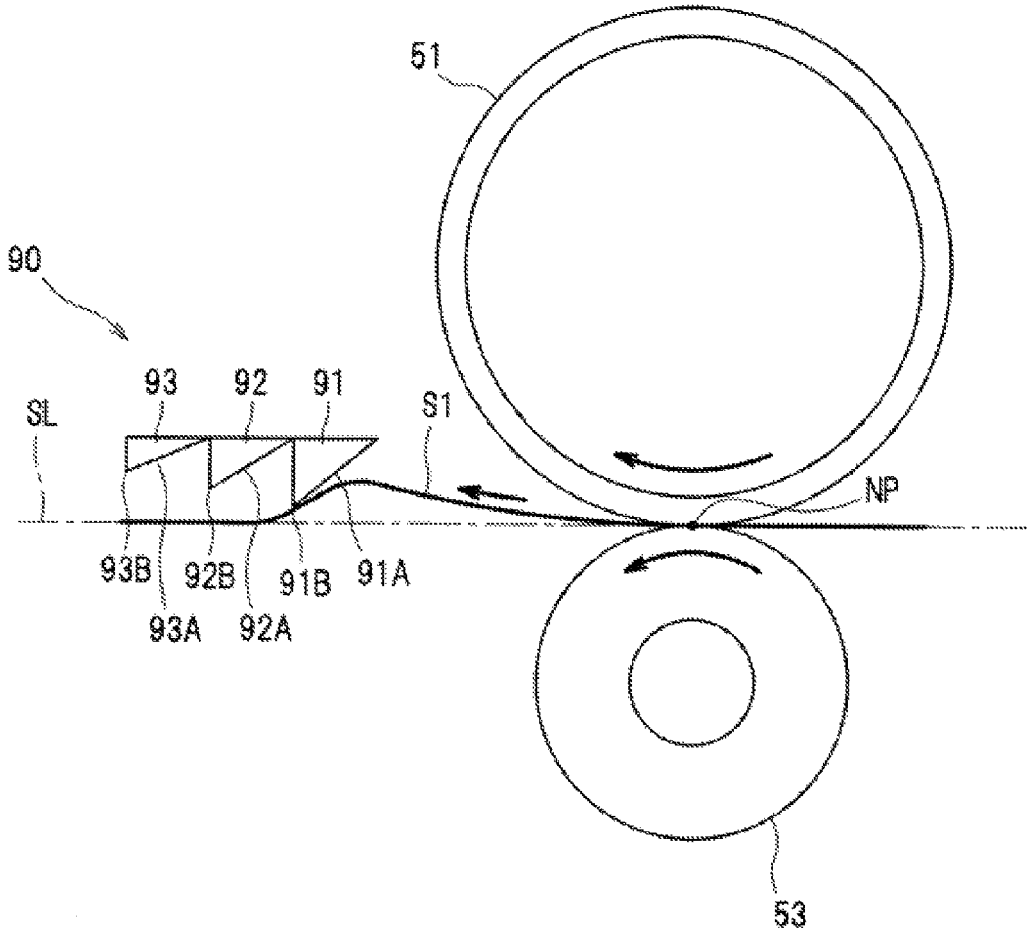
FIG. 4 is a pictorial side view illustrating an operation of the recording sheet guide structure according to an illustrative embodiment.

Here, as shown in FIG. 4, when a conveyance reference plane of the sheet S1, which is conveyed between the photosensitive drum 51 and the transfer roller 53, is denoted with the dashed-dotted line and a reference numeral SL, a distance between the second guide parts 92, 92 and the conveyance reference plane SL is set to be larger than a distance between the first guide parts 91, 91 and the conveyance reference plane SL, and a distance between the third guide parts 93, 93 and the conveyance reference plane SL is set to be larger than the distance between the second guide parts 92, 92 and the conveyance reference plane SL. Note that, the conveyance reference plane SL is a plane including a nip portion NP at which the photosensitive drum 51 and the transfer roller 53 sandwich the sheet S therebetween, and is a common contact plane of the photosensitive drum 51 and the transfer roller 53.

<Inclinations of Respective Ridgeline Parts of Respective Guide Parts>

As shown in FIG. 5, each of the first ridgeline parts 91B, 91B of the pair of first guide parts 91, 91 is inclined so that a distance from the conveyance reference plane SL of the sheet S1 is increased towards the inner side of the sheet S1 shown in FIG. 3 in the width direction, each of the second ridgeline parts 92B, 92B of the pair of second guide parts 92, 92 is inclined so that a distance from the conveyance reference plane SL of the sheet S2 is increased towards the inner side of the sheet S2 shown in FIG. 3 in the width direction, and each of the third ridgeline parts 93B, 93B of the pair of third guide parts 93, 93 is inclined so that a distance from the conveyance reference plane SL of the sheet S3 is increased towards the inner side of the sheet S3 shown in FIG. 3 in the width direction.

Figure 5A:
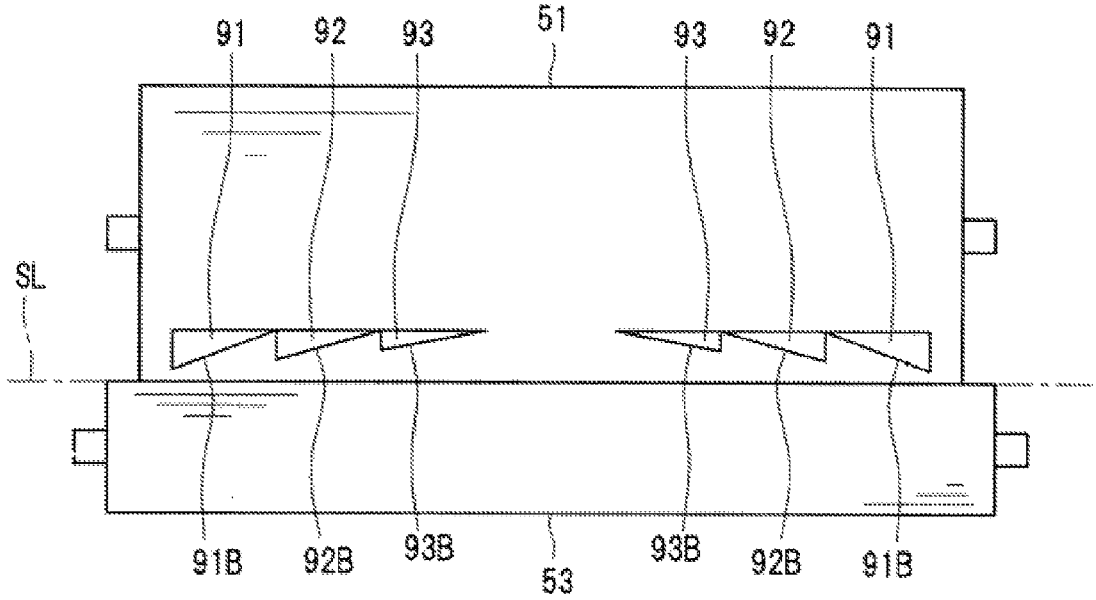
FIG. 5A is a pictorial front view of the recording sheet guide structure and FIG. 5B is a partially enlarged front view of the recording sheet guide structure.
Figure 5B:
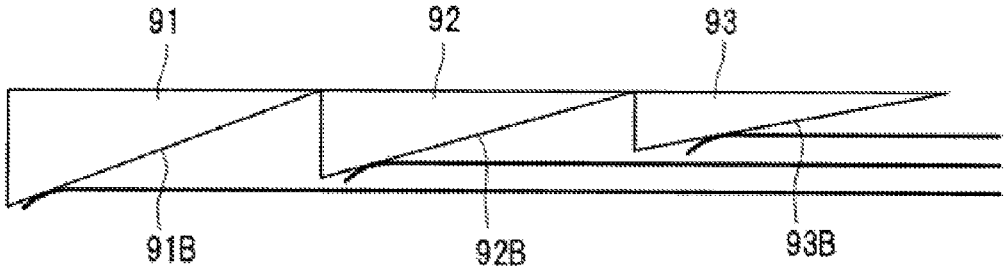

Here, as shown in FIG. 5 (FIG. 5A and FIG. 5B), an inclination angle of each ridgeline part with respect to the conveyance reference plane SL, when viewed from the conveyance direction of the sheet S, is set so that inclination angles of the second ridgeline parts 92B, 92B are smaller than those of the first ridgeline parts 91B, 91B, and inclination angles of the third ridgeline parts 93B, 93B are smaller than those of the second ridgeline parts 92B, 92B. Therefore, lengths of the second ridgeline parts 92B, 92B can be sufficiently secured while setting the distances between the second guide parts 92, 92 and the conveyance reference plane SL to be larger than the distances between the first guide parts 91, 91 and the conveyance reference plane SL. Further, lengths of the third ridgeline parts 93B, 93B can be sufficiently secured while setting the distances between the third guide parts 93, 93 and the conveyance reference plane SL to be larger than the distances between the second guide parts 92, 92 and the conveyance reference plane SL.

<Operations of Recording Sheet Guide Structure>

In the recording sheet guide structure 90 of this illustrative embodiment configured as described above, when the sheet S is conveyed between the photosensitive drum 51 configuring the image carrier and the transfer roller 53 configuring the transfer part towards the fixing part 60, if the front end portion of the sheet S is not curved towards the photosensitive drum 51, the sheet S is conveyed towards the fixing part 60 without contacting with the first guide parts 91, 91, the second guide parts 92, 92 and the third guide parts 93, 93.

Here, when the sheet S, which is conveyed between the photosensitive drum 51 and the transfer roller 53 towards the fixing part 60, is the A4-sized sheet S1 and the front end portion thereof is curved towards the photosensitive drum 51, as shown in FIGS. 3 and 4, the sheet S1 abuts on the first guide inclined surfaces 91A, 91A of the first guide parts 91, 91 at both end portions of the front end portion thereof in the width direction and is thus guided to the first ridgeline parts 91B, 91B. Then, the transfer surface side of both end portions of the sheet S1 in the width direction slidingly contacts with the first ridgeline parts 91B, 91B. Thereby, as shown in FIG. 5B, the sheet S1 has a curved section shape in which a section shape perpendicular to the conveyance direction is convex towards the transfer surface side, so that the sheet S1 is guided in the direction of being separated from the photosensitive drum 51.

When the A4-sized sheet S1 having the front end portion curved towards the photosensitive drum 51 is guided in the direction of being separated from the photosensitive drum 51 by the first guide parts 91, 91, it is difficult for the second guide parts 92, 92 and the third guide parts 93, 93 to contact with the transfer surface of the sheet S1 and to contaminate the transfer surface of the sheet S1 because the second guide parts 92, 92 and the third guide parts 93, 93 within the width of the conveyance path of the sheet S1 are arranged at the downstream side in the conveyance direction of the sheet S than the first guide parts 91, 91 and are spaced from the conveyance reference plane SL of the sheet S than the first guide parts 91, 91.

Also, when the sheet S, which is conveyed between the photosensitive drum 51 and the transfer roller 53 towards the fixing part 60, is the B5-sized sheet S2 and the front end portion thereof is curved towards the photosensitive drum 51, as shown in FIG. 3, the sheet S2 abuts on the second guide inclined surfaces 92A, 92A of the second guide parts 92, 92 at both end portions of the front end portion thereof in the width direction and is thus guided to the second ridgeline parts 92B, 92B. Then, the transfer surface side of both end portions of the sheet S2 in the width direction slidingly contacts with the second ridgeline parts 92B, 92B. Thereby, as shown in FIG. 5B, the sheet S2 has a curved section shape in which a section shape perpendicular to the conveyance direction is convex towards the transfer surface side, so that the sheet S2 is guided in the direction of being separated from the photosensitive drum 51.

When the B5-sized sheet S2 having the front end portion curved towards the photosensitive drum 51 is guided in the direction of being separated from the photosensitive drum 51 by the second guide parts 92, 92, it is difficult for the third guide parts 93, 93 to contact with the transfer surface of the sheet S2 and to contaminate the transfer surface of the sheet S2 because the third guide parts 93, 93 within the width of the conveyance path of the sheet S2 are arranged at the downstream sides in the conveyance direction of the sheet S than the second guide parts 92, 92 and are spaced from the conveyance reference plane SL of the sheet S than the second guide parts 92, 92. Meanwhile, the first guide parts 91, 91 do not contact with the transfer surface of the sheet S2 and do not contaminate the transfer surface because the first guide parts 91, 91 are arranged outside of the width of the conveyance path of the sheet S2.

Also, when the sheet S, which is conveyed between the photosensitive drum 51 and the transfer roller 53 towards the fixing part 60, is the A5-sized sheet S3 and the front end portion thereof is curved towards the photosensitive drum 51, as shown in FIG. 3, the sheet S3 abuts on the third guide inclined surfaces 93A, 93A of the third guide parts 93, 93 at both end portions of the front end portion thereof in the width direction and is thus guided to the third ridgeline parts 93B, 93B. Then, the transfer surface side of both end portions of the sheet S3 in the width direction slidingly contacts with the third ridgeline parts 93B, 93B. Thereby, as shown in FIG. 5B, the sheet S3 has a curved section shape in which a section shape perpendicular to the conveyance direction is convex towards the transfer surface side, so that it is guided in the direction of being separated from the photosensitive drum 51.

When the A5-sized sheet S3 having the front end portion curved towards the photosensitive drum 51 is guided in the direction of being separated from the photosensitive drum 51 by the third guide parts 93, 93, the first guide parts 91, 91 and the second guide parts 92, 92 do not contact with the transfer surface of the sheet S3 and do not contaminate the transfer surface because the first guide parts 91, 91 and the second guide parts 92, 92 are arranged outside of the width of the conveyance path of the sheet S3.

Therefore, accordion to the recording sheet guide structure 90 of this illustrative embodiment, irrespective of the width size of the sheet S that is conveyed between the photosensitive drum 51 configuring the image carrier and the transfer roller 53 configuring the transfer part towards the fixing part 60, it is possible to convey the A4-sized sheet S1, the B5-sized sheet S2 and the A5-sized sheet S3 while being appropriately separated from the photosensitive drum 51 so that a jam is not caused. Also, it is possible to convey the sheet while suppressing the contamination of the transfer surface.

Although an illustrative embodiment of the recording sheet guide structure of the invention has been described, the recording sheet guide structure of the invention is not limited to the above-described illustrative embodiment and the configuration thereof can be appropriately changed. For example, fourth guide parts that correspond to a postcard-sized sheet having a width narrower than the A5-sized sheet S3 may be further provided.

The fourth guide parts are provided at the inner side of the third guide parts 93, 93 in the width direction and are arranged at a downstream side in the conveyance direction of the sheet S than the third guide parts 93, 93. A distance between the fourth guide parts and the conveyance reference plane SL is preferably set to be larger than the distance between the third guide parts 93, 93 and the conveyance reference plane SL. Also, inclination angles of fourth ridgeline parts of the fourth guide parts with respect to the conveyance reference plane SL, which is viewed in the conveyance direction of the sheet S, are preferably set to be smaller than the inclination angles of the third ridgeline parts 93B, 93B of the third guide parts 93, 93.

In addition, the photosensitive drum 51 configuring the image carrier can be changed to an intermediate transfer belt. In this case, the sheet S is conveyed between the intermediate transfer belt configuring the image carrier and the transfer roller configuring the transfer part.

Figure 6:
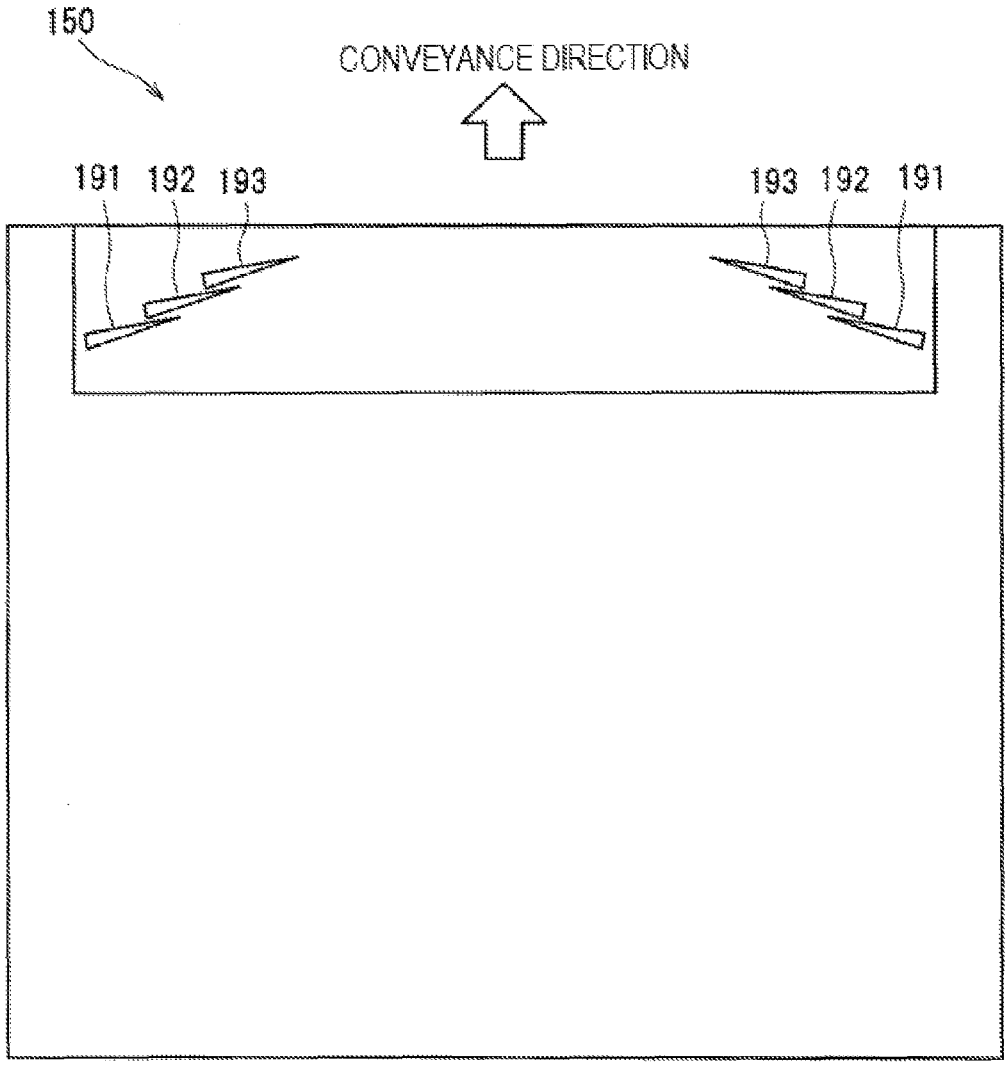
FIG. 6 is a process cartridge according to a modified embodiment, which is viewed from a bottom surface side.

In addition, in the above illustrative embodiment, the second guide parts 92, 92 are entirely arranged at the inner side of the first guide parts 91, 91 in the width direction of the recording sheet and are entirely arranged at the downstream side in the conveyance direction of the recording sheet than the first guide parts 91, 91. Further, the third guide parts 93, 93 are entirely arranged at the inner side of the second guide parts 92, 92 in the width direction of the recording sheet and are entirely arranged at the downstream side in the conveyance direction of the recording sheet than the first guide parts 91, 91. However, the invention is not limited thereto. For example, as shown in a process cartridge 150 of FIG. 6, second guide parts 192, 192 may be positioned at the inner side of first guide parts 191, 191 in the width direction while partially overlapping the first guide parts 191, 191 in the width direction. Further, the second guide parts 192, 192 may be positioned at the downstream side in the conveyance direction than the first guide parts 191, 191 while partially overlapping the first guide parts 191, 191 in the conveyance direction. Likewise, third guide parts 193, 193 may be positioned at the inner side regarding the second guide parts 192, 192 in the width direction while partially overlapping regarding the second guide parts 192, 192 in the width direction. Further, the third guide parts 193, 193 may be positioned at the downstream side in the conveyance direction than the second guide parts 192, 192 while partially overlapping the second guide parts 192, 192 in the conveyance direction.

In addition, the invention can be applied to a cartridge such as a drum cartridge and a process cartridge 50 having at least the recording sheet guide structure 90 and the photosensitive drum 51. In the cartridge, the recording sheet guide structure 90 may be integrally formed with the frame 58 holding the photosensitive drum 51, and the like.

The present invention provides illustrative, non-limiting aspects as follows:

(1) In a first aspect, there is provided a recording sheet guide structure configured to guide a recording sheet conveyed between an image carrier and a transfer part, the recording sheet guide structure including: a pair of first guide parts including first ridgeline parts which are configured to respectively slidingly contact with a transfer surface side of both end portions of a first recording sheet having a first width in a width direction, and configured to guide the both end portions of the first recording sheet in a direction of separating the first recording sheet from the image carrier; and a pair of second guide parts including second ridgeline parts which are configured to respectively slidingly contact with a transfer surface side of both end portions of a second recording sheet having a second width narrower than the first width of the first recording sheet in the width direction, and configured to guide the both end portions of the second recording sheet in a direction of separating the second recording sheet from the image carrier, wherein the pair of second guide parts is positioned at an inner side of the pair of first guide parts in the width direction and is arranged at a downstream side than the pair of first guide parts in a conveyance direction of the recording sheet.

Accordingly, when the first recording sheet is conveyed between the image carrier and the transfer part, if a front end portion of the first recording sheet is curved towards the image carrier, the first ridgeline parts of the pair of first guide parts slidingly contact the transfer surface side of both end portions of the first recording sheet in the width direction. Therefore, the first recording sheet can be guided in the direction of being separated from the image carrier. Here, although the pair of second guide parts is arranged within a width of a conveyance path of the first recording sheet, the second guide parts are arranged at the downstream sides than the first guide parts in the conveyance direction of the recording sheet. Therefore, it becomes difficult for the second guide parts to contact the transfer surface of the first recording sheet and to thereby contaminate the transfer surface of the first recording sheet.

Meanwhile, when the second recording sheet having a width narrower than the first recording sheet is conveyed between the image carrier and the transfer part, if a front end portion of the second recording sheet is curved towards the image carrier, the second ridgeline parts of the pair of second guide parts slidingly contact the transfer surface side of both end portions of the second recording sheet in the width direction. Therefore, the second recording sheet can be guided in the direction of separating from the image carrier. Here, since the first guide parts are arranged outside of a width of the conveyance path of the second recording sheet, the pair of first guide parts does not contact with the transfer surface of the second recording sheet, and therefore, does not contaminate the transfer surface of the second recording sheet.

(2) In a second aspect, there is provided the recording sheet guide structure according to the first aspect, wherein a distance between the pair of second guide parts and a conveyance reference plane of the recording sheet conveyed between the image carrier and the transfer part is larger than a distance between the pair of first guide parts and the conveyance reference plane.

Accordingly, since the pair of second guide parts becomes distant from the transfer surface of the first recording sheet, it becomes more difficult for the second guide parts to contact with the transfer surface of the first recording sheet.

(3) In a third aspect, there is provided The recording sheet guide structure according to the first or second aspect, wherein the first ridgeline part is inclined so that a distance between the first ridgeline part and a conveyance reference plane of the recording sheet conveyed between the image carrier and the transfer part is increased towards the inner side of the first recording sheet in the width direction, and wherein the second ridgeline part is inclined so that a distance between the second ridgeline part and the conveyance reference plane is increased towards the inner side of the second recording sheet in the width direction.

Accordingly, the first recording sheet that is conveyed between the image carrier and the transfer part slidingly contacts with the pair of first ridgeline parts at the transfer surface side of both end portions thereof in the width direction and is thus inclined. Thereby, the first recording sheet has a curved section shape in which a section shape perpendicular to the conveyance direction of the first recording sheet is convex towards the transfer surface side. Therefore, it becomes easier for the first recording sheet to separate from the image carrier. Further, the second recording sheet that is conveyed between the image carrier and the transfer part slidingly contacts with the pair of second ridgeline parts at the transfer surface side of both end portions thereof in the width direction and is thus inclined. Thereby, the second recording sheet has a curved section shape in which a section shape perpendicular to the conveyance direction of the second recording sheet is convex towards the transfer surface side. Therefore, it becomes easier for the second recording sheet to separate from the image carrier.

(4) In a fourth aspect, there is provided the recording sheet guide structure according to the third aspect, wherein an inclination angle of the second ridgeline part when viewed in the conveyance direction of the recording sheet is smaller than an inclination angle of the first ridgeline part when viewed in the conveyance direction of the recording sheet.

Accordingly, it is possible to secure sufficient lengths of the second ridgeline parts of the pair of second guide parts while setting the distance between the conveyance reference plane of the recording sheet and the pair of second guide parts to be large.

(5) In a fifth aspect, there is provided the recording sheet guide structure according to the first aspect, wherein the pair of first guide parts are entirely positioned at the downstream side than the image carrier in the conveyance direction of the recording sheet.

(6) In a sixth aspect, there is provided the recording sheet guide structure according to the first aspect, wherein, when viewed in the conveyance direction of the recording sheet, an area of the pair of first guide parts is larger than an area of the pair of the second guide parts.

(7) In a seventh aspect, there is provided the recording sheet guide structure according to the first aspect, wherein the first recording sheet is an A4-sized sheet.

(8) In an eighth aspect, there is provided the recording sheet guide structure according to the first aspect, wherein the second recording sheet is a B5-sized sheet.

(9) In a ninth aspect, there is provided the recording sheet guide structure according to the first aspect, further comprising a pair of third guide parts including third ridgeline parts which are configured to respectively slidingly contact with a transfer surface side of both end portions of a third recording sheet having a third width narrower than the second width in the width direction, and configured to guide the both end portions of the third recording sheet in a direction of separating the third recording sheet from the image carrier, wherein the pair of third guide parts is positioned at an inner side of the pair of second guide parts in the width direction and is arranged at a downstream side than the pair of second guide parts in the conveyance direction of the recording sheet.

(10) In a tenth aspect, there is provided the recording sheet guide structure according to the ninth aspect, wherein the third recording sheet is an A5-sized sheet.

(11) In a eleventh aspect, there is provided a cartridge including: an image carrier; and a recording sheet guide structure configured to guide a recording sheet conveyed between the image carrier and a transfer part, the recording sheet guide structure including: a pair of first guide parts including first ridgeline parts which are configured to respectively slidingly contact with a transfer surface side of both end portions of a first recording sheet having a first width in a width direction, and configured to guide the both end portions of the first recording sheet in a direction of separating the first recording sheet from the image carrier; and a pair of second guide parts including second ridgeline parts which are configured to respectively slidingly contact with a transfer surface side of both end portions of a second recording sheet having a second width narrower than the first width of the first recording sheet in the width direction, and configured to guide the both end portions of the second recording sheet in a direction of separating the second recording sheet from the image carrier, wherein the pair of second guide parts is positioned at an inner side of the pair of first guide parts in the width direction and is arranged at a downstream side than the pair of first guide parts in a conveyance direction of the recording sheet.

(12) In a twelfth aspect, there is provided the cartridge according to the eleventh aspect, further comprising a frame holding the image carrier, wherein the pair of first guide parts and the pair of second guide parts are integrally formed with the frame.

(13) In a thirteenth aspect, there is provided a cartridge including: an image carrier extending a first direction; and a frame configured to accommodate the image carrier and including a first guide part and a second guide part, wherein the first guide part includes a first ridgeline part which is configured to respectively slidingly contact with a transfer surface side of an end portion of a first recording sheet in the first direction, and configured to guide the transfer surface end portion of the first recording sheet in a direction of separating the first recording sheet from the image carrier, wherein the second guide part includes a second ridgeline part which is configured to respectively slidingly contact with a transfer surface side of an end portion of a second recording sheet having a second width narrower than a first width of the first recording sheet in the first direction, and configured to guide the end portion of the second recording sheet in a direction of separating the second recording sheet from the image carrier, and wherein the second guide part is positioned at an inner side of the first guide part in the first direction and is arranged at a downstream side than the first guide part in a conveyance direction of the recording sheet.

What is claimed is:

1. A recording sheet guide structure configured to guide a recording sheet conveyed between an image carrier and a transfer part, the recording sheet guide structure comprising:

a pair of first guide parts including first ridgeline parts which are configured to respectively slidingly contact with a transfer surface side of both end portions of a first recording sheet having a first width in a width direction, and configured to guide the both end portions of the first recording sheet in a direction of separating the first recording sheet from the image carrier; and a pair of second guide parts including second ridgeline parts which are configured to respectively slidingly contact with a transfer surface side of both end portions of a second recording sheet having a second width narrower than the first width of the first recording sheet in the width direction, and configured to guide the both end portions of the second recording sheet in a direction of separating the second recording sheet from the image carrier, wherein the pair of second guide parts is positioned at an inner side of the pair of first guide parts in the width direction and is arranged further downstream than the pair of first guide parts in a conveyance direction of the recording sheet, and wherein a distance between the pair of second guide parts and a conveyance reference plane of the recording sheet conveyed between the image carrier and the transfer part is larger than a distance between the pair of first guide parts and the conveyance reference plane, the conveyance reference plane being substantially parallel to the conveyance direction of the recording sheet.

2. The recording sheet guide structure according to claim 1, wherein at least one of the first ridgeline parts is inclined so that a distance between the at least one of the first ridgeline parts and the conveyance reference plane of the recording sheet conveyed between the image carrier and the transfer part is increased towards the inner side of the first recording sheet in the width direction, and wherein at least one of the second ridgeline parts is inclined so that a distance between the at least one of the second ridgeline parts and the conveyance reference plane is increased towards the inner side of the second recording sheet in the width direction.

3. The recording sheet guide structure according to claim 2, wherein an inclination angle of the at least one of the second ridgeline parts when viewed in the conveyance direction of the recording sheet is smaller than an inclination angle of the at least one of the first ridgeline parts when viewed in the conveyance direction of the recording sheet.

4. The recording sheet guide structure according to claim 1, wherein the pair of first guide parts are entirely positioned further downstream than the image carrier in the conveyance direction of the recording sheet.

5. The recording sheet guide structure according to claim 1, wherein, when viewed in the conveyance direction of the recording sheet, an area of the first guide parts is larger than an area of the second guide parts.

6. The recording sheet guide structure according to claim 1,wherein the first recording sheet is an A4-sized sheet.

7. The recording sheet guide structure according to claim 1, wherein the second recording sheet is a B5-sized sheet.

8. The recording sheet guide structure according to claim 1, further comprising a pair of third guide parts including third ridgeline parts which are configured to respectively slidingly contact with a transfer surface side of both end portions of a third recording sheet having a third width narrower than the second width in the width direction, and configured to guide the both end portions of the third recording sheet in a direction of separating the third recording sheet from the image carrier, wherein the pair of third guide parts is positioned at an inner side of the pair of second guide parts in the width direction and is arranged further downstream than the pair of second guide parts in the conveyance direction of the recording sheet.

9. The recording sheet guide structure according to claim 8, wherein the third recording sheet is an A5-sized sheet.

10. The recording sheet guide structure according to claim 1, wherein the pair of first guide parts directly contacts with the pair of second guide parts.

11. A cartridge comprising:

an image carrier; and a recording sheet guide structure configured to guide a recording sheet conveyed between the image carrier and a transfer part, the recording sheet guide structure including:

a pair of first guide parts including first ridgeline parts which are configured to respectively slidingly contact with a transfer surface side of both end portions of a first recording sheet having a first width in a width direction, and configured to guide the both end portions of the first recording sheet in a direction of separating the first recording sheet from the image carrier; and a pair of second guide parts including second ridgeline parts which are configured to respectively slidingly contact with a transfer surface side of both end portions of a second recording sheet having a second width narrower than the first width of the first recording sheet in the width direction, and configured to guide the both end portions of the second recording sheet in a direction of separating the second recording sheet from the image carrier, wherein the pair of second guide parts is positioned at an inner side of the pair of first guide parts in the width direction and is arranged further downstream than the pair of first guide parts in a conveyance direction of the recording sheet, and wherein a distance between the pair of second guide parts and a conveyance reference plane of the recording sheet conveyed between the image carrier and the transfer part is larger than a distance between the pair of first guide parts and the conveyance reference plane, the conveyance reference plane being substantially parallel to the conveyance direction of the recording sheet.

12. The cartridge according to claim 11, further comprising a frame holding the image carrier, wherein the pair of first guide parts and the pair of second guide parts are integrally formed with the frame.

13. A cartridge comprising:

an image carrier extending in a first direction; and a frame configured to accommodate the image carrier and including a first guide part and a second guide part, wherein the first guide part includes a first ridgeline part which is configured to respectively slidingly contact with a transfer surface side of an end portion of a first recording sheet in the first direction, and configured to guide the end portion of the first recording sheet in a direction of separating the first recording sheet from the image carrier, wherein the second guide part includes a second ridgeline part which is configured to respectively slidingly contact with a transfer surface side of an end portion of a second recording sheet having a second width narrower than a first width of the first recording sheet in the first direction, and configured to guide the end portion of the second recording sheet in a direction of separating the second recording sheet from the image carrier, and wherein the second guide part is positioned at an inner side of the first guide part in the first direction and is arranged further downstream than the first guide part in a conveyance direction of the recording sheet, and wherein a distance between the second guide part and a conveyance reference plane of the recording sheet conveyed between the image carrier and a transfer part is larger than a distance between the first guide part and the conveyance reference plane, the conveyance reference plane being substantially parallel to the conveyance direction of the recording sheet.

* * * * *